US005845720A

United States Patent [19]

Borjeson et al.

[11] Patent Number: 5,845,720

[45] Date of Patent: Dec. 8, 1998

[54] METHOD FOR PROVIDING A SUBSTANTIALLY LEAKPROOF SHIELDING LAYER IN THE GROUND AND A DEVICE FOR PERFORMING THE METHOD

[75] Inventors: Niclas Borjeson, Solna; Sten-Ake Pettersson, Stenhamra, both of Sweden

[73] Assignee: Atlas Copco Craelius AB, Sweden

[21] Appl. No.: 693,038

[22] PCT Filed: Feb. 9, 1995

[86] PCT No.: PCT/SE95/00132

§ 371 Date: Nov. 4, 1996

§ 102(e) Date: Nov. 4, 1996

[87] PCT Pub. No.: WO95/21989

PCT Pub. Date: Aug. 17, 1995

[30] Foreign Application Priority Data

Feb. 11, 1994 [SE] Sweden ..... 9400465

[51] Int. Cl.[6] ..... E21B 7/26; E02D 7/00

[52] U.S. Cl. ..... 175/19; 61/35

[58] Field of Search ..... 175/19, 21, 23; 61/35; 166/285, 289, 290

[56] References Cited

U.S. PATENT DOCUMENTS

| | | | |
|---|---|---|---|
| 2,729,067 | 1/1956 | Patterson | 61/35 |
| 3,023,585 | 3/1962 | Liver | 61/63 |
| 3,485,052 | 12/1969 | Turzillo | 61/36 R |
| 3,800,544 | 4/1974 | Nakanishi . | |
| 4,785,885 | 11/1988 | Cherrington et al. . | |
| 4,867,240 | 9/1989 | Colla . | |
| 4,905,773 | 3/1990 | Kinnan | 175/19 |
| 4,928,775 | 5/1990 | Lee | 175/19 |
| 5,002,137 | 3/1991 | Dickinson et al. | 175/19 |

FOREIGN PATENT DOCUMENTS

| | | |
|---|---|---|
| 0 195 559 | 9/1986 | European Pat. Off. . |

*Primary Examiner*—Frank Tsay
*Attorney, Agent, or Firm*—Barnes & Thornburg

[57] ABSTRACT

A method of providing a substantially leakproof shielding layer in the ground. The method includes the following steps: a) making a plurality of substantially parallel holes (H) in the ground by means of a guided drill head (4) which ejects ground-decomposing liquid mainly in the advance direction of the head, and b) passing through each hole an injection head (6) which ejects injection liquid essentially transversely to the advance direction thereof, so that the injection liquid will penetrate into the ground material and mix therewith and after transition to a solid state, together with injection liquid in an adjacent hole, which has also penetrated into and mixed with the ground material and has been transformed into a solid state, will form part of the shielding layer. The invention further includes a device for performing the method.

10 Claims, 2 Drawing Sheets

METHOD FOR PROVIDING A SUBSTANTIALLY LEAKPROOF SHIELDING LAYER IN THE GROUND AND A DEVICE FOR PERFORMING THE METHOD

TECHNICAL FIELD

The present invention relates to a method of providing a substantially leakproof shielding layer in the ground and a device for performing the method. A shielding layer of this kind is necessary to delimit a ground area from the surrounding ground, such that material accumulated in said area will not spread thereby causing contamination or damage. Examples of such ground areas are refuse dumps and bodies of water.

PRIOR ART

It is previously known to make long holes in the ground the extension of which may be horizontal, for example under a road. Examples of a device capable of making such holes are given in EP 0 195 559. Said device includes a head connected to a drill string and having nozzles which under high pressure and at high speed eject liquid that carries out the making of the holes. The head is provided with means to orientate it round its longitudinal axis thereby to guide the head in a desired course.

It is also previously known to insert into a drill hole an injection head provided with nozzles which under high pressure eject a liquid injection medium which will mix with the ground material surrounding the hole and, on removal of the head, will solidify and form a leakproof layer.

SUMMARY OF THE INVENTION

It is an object of the present invention to provide a method and a device by which a shielding layer can be provided in a simple and economical way by the use of simple means.

This object is achieved in that the invention has been given the features stated in the characterizing portions of the independent claims.

PREFERRED EMBODIMENTS

A ground area consisting of porous rock and/or soil, in which a shielding layer is to be provided, is indicated at M1. In and/or on this area there is an area M2 with, for example, refuse matter, to be screened off from the surrounding ground area in order to prevent, for example, contamination thereof.

Figure 1:
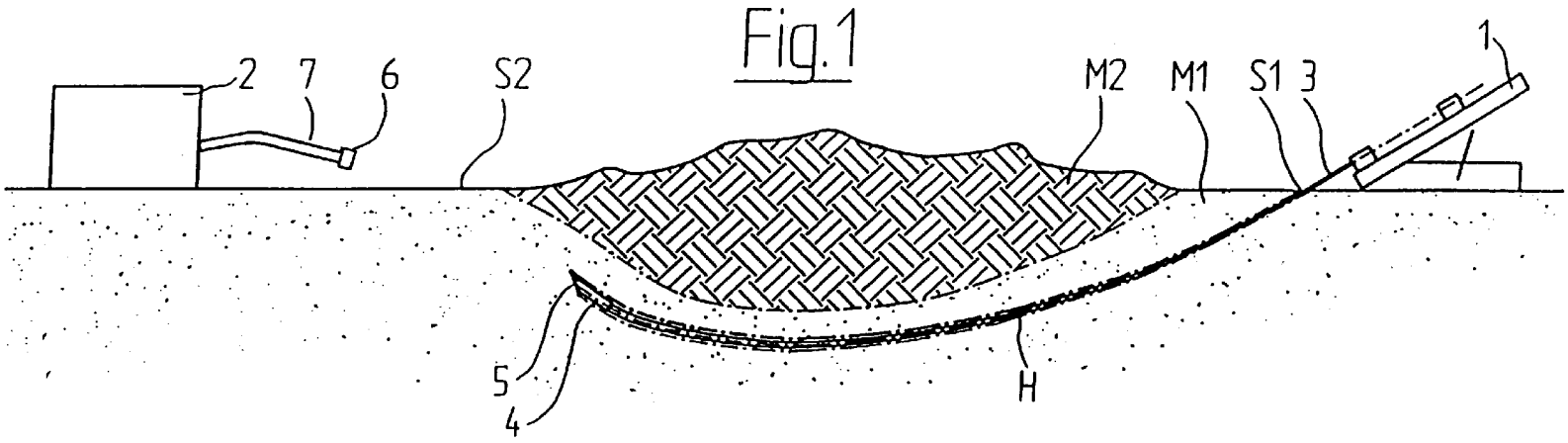
FIG. 1 is a schematic side view, in section, showing a ground area with a partially made hole and a device for performing the method according to the invention.
Figure 2:
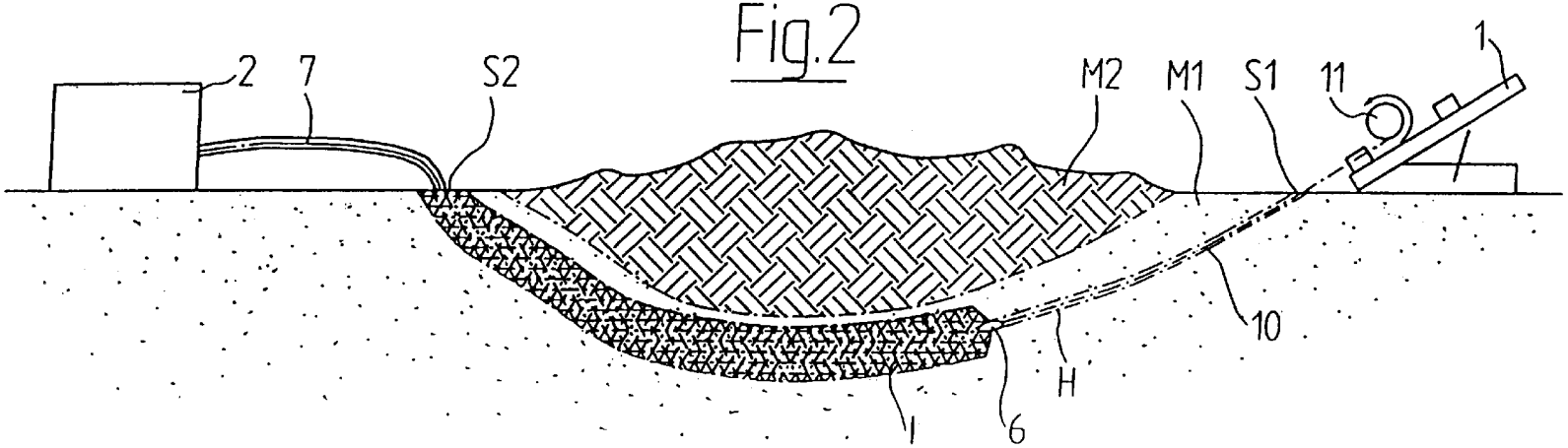
FIG. 2 is a schematic side view, in section, showing the ground area and the device of FIG. 1, wherein the hole is completely made and partly injected.

In FIGS. 1 and 2 there is shown a machine 1 and a plant 2 placed on the ground surface on either side of the area M2. The machine 1 is a drilling machine, for instance of the kind marketed by Atlas Copco AB, Stockholm, Sweden, under the registered trademark of TERRABOR, while the plant 2 is a jet injection plant, for example of the kind made by Colla CCP International, Parma, Italy, and referred to as Jet Grouting. The drilling machine 1 is designed so as to be able to feed a tubular, flexible drill string 3 backwards and forwards and also rotate it round the longitudinal axis of the drill string. One end of the drill string 3 is detachably connected to a drill head 4 which is known per se, such as a drill head shown in SE-B 464 146. Said drill head is provided with an oblique leading guide surface 5 and one or more nozzles (not shown) in the front portion of the head, through which fluid can be ejected under high pressure and at high speed. The fluid is fed through the drill string 3 from a source (not shown) placed at the machine. The drill head 4 is provided with means (not shown) which are known per se and which provide the operator of the machine 1 with information on the orientation of the head round its longitudinal axis as well as on the distance of the head from the ground surface.

During the advance of the drill head 4 achieved by the machine 1, beginning at a location S1 and ending at a location S2 on the ground surface, the head makes an elongated, substantially horizontal hole H in the ground under the area M2.

When the drill head 4 has penetrated the ground surface at the location S2 and the supply of fluid has been interrupted, the head is released from the end of the drill string 3. The plant 2 includes an essentially cylindrical injection head 6, which is provided with one or more nozzles (not shown) round its periphery and which is then mounted to said end of the drill string 3. The head 6 is connected to a hose 7 which is wound at the plant 2 and is connected via a pump (not shown) to a source of injection medium in the form of a fluid, usually consisting of a mixture of water, concrete and bentonite.

The drill string 3 is retracted through the hole H by the machine until the head 6 is accessible at the location S1 when it is disconnected from the drill string. The head 6 is then drawn back into the hole H by means of the hose 7 towards the location S2 while the injection medium is ejected under high pressure and at high speed (=jet injection 200–800 bars) from the nozzles of the head substantially transversely to the longitudinal axis of the head. During ejection, the medium enters into the walls of the hole and into the adjacent ground material and mixes therewith. When the head 6 has been returned to the location S2, injection is completed. After a certain length of time, the injection medium will solidify, making the hole and the surrounding parts of the ground substantially leakproof.

Instead of removing the drill head 4 from the drill string 3 first and thereafter connecting the injection head 6 to the free end of the drill string, as described in the preceding paragraphs, the drill head can stay mounted to the drill string and the injection head can be connected thereto at the location S2. When the injection head has reached the location S1, the head is disconnected from the drill head and the injection head is retracted.

After making several holes, corresponding to the hole H, which are substantially parallel to and equally spaced from each other, and after injection into these in the above described way, the injected holes together will form a leakproof shielding layer under the entire area M2.

Figure 3:
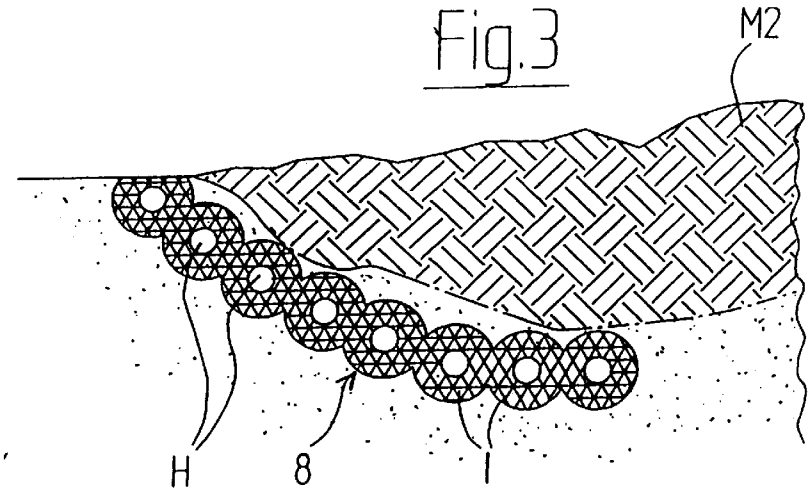
FIG. 3 is a section along the line A—A of FIG. 2 according to a first type of extension of the injection.
Figure 4:
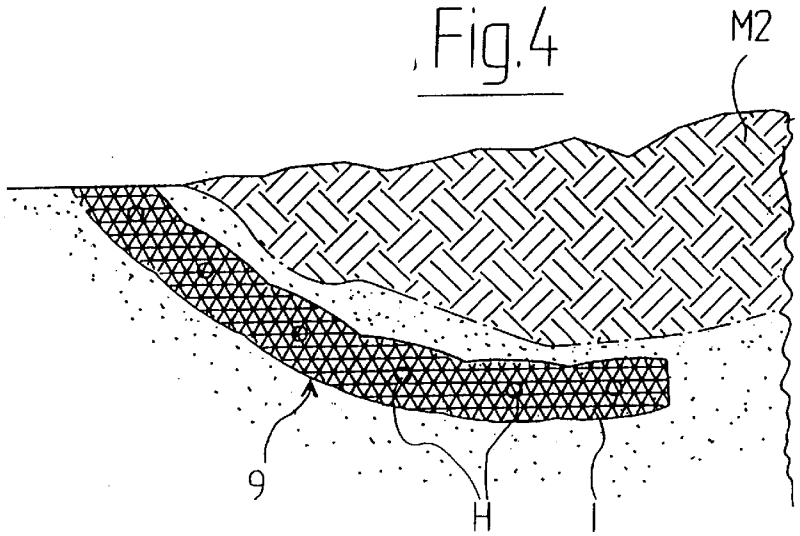
FIG. 4 is a section along the same line A—A of FIG. 2 according to a second type of extension of the injection.

As is evident from FIGS. 3 and 4, showing a portion 8 and 9 respectively of said shielding layer, seen in a cross-sectional view transversely to the longitudinal axis of the hole H of FIG. 1, the distances between the holes H are spanned by the injection medium I present in the holes and the surrounding ground. In FIG. 3 injection has been carried out by means of an injection head which has several nozzles round its periphery and which has not been oriented round its longitudinal axis, while in FIG. 4 injection has been carried out using a head which has several nozzles placed in such a way as for injection medium to be ejected essentially in two opposite directions only and which has been oriented round its longitudinal axis, so that the injection medium will mainly spread horizontally in the ground surrounding the drill hole.

Figure 5:
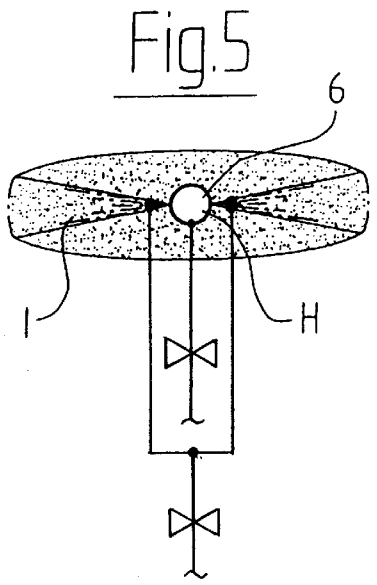
FIG. 5 is a view of a portion of FIG. 4, on an enlarged scale.

FIG. 5 shows one of the holes H of FIG. 4 and the Injection head 6 therein during ejection of injection medium According to an alternative arrangement of the above described method shown in FIG. 2, the drill head 4 (or the end of the drill string 3 from which the drill head is disconnected) after the drilling of the hole H is immediately connected to a long wire cable 10 and is drawn through the hole when the drill string is retracted therethrough by the machine 1. On removal of the entire drill string from the hole H, the wire cable is disconnected from the drill string at the location S1, and the injection head 6 is connected to the wire cable at the location S2, whereupon the wire cable is drawn through the hole by a hoist 11, disposed adjacent the machine 1, at an even speed while the injection medium is ejected through the injection head 6. On disconnection of the wire cable from the injection head, the injection hose 7 is retracted through the hole towards the location S2 with or without the injection head. As may be seen from FIG. 2, the injection head 6 has been drawn to the right by the wire cable 10 about one third of the length of the hole H and during this distance has injected the hole and the area around it.

According to a further alternative arrangement, the machine 1 and the plant 2 may both be placed at the location S1. After the hole H has been drilled by the head 4 and the drill string 3 has been retracted by the machine 1, the head 4 is removed from the drill string 3 at the location S1 and the head is then attached thereto. The machine 1 will then press the head 6, via the drill string 3, through the hole H to the location S2 and will thereafter retract the head to the location S1. Injection medium is fed via the drill string 3 through the head 6 in one feed direction or in both. Owing to the head 6 being connected to the drill string, which is substantially rigid in the circumferential direction, the head 6 may be oriented round its longitudinal axis and is able to provide the injection pattern shown in FIGS. 4 and 5.

Alternatively to the latter described arrangement in which the machine 1 and the plant 2 are placed at the location S1, a wire armed hose may be drawn through the hole, after or in connection with the making of the hole H in the above described way, whereupon the injection head 6 is attached to the free end of the hose at the location S2. Injection takes place in that injection medium is ejected through the head 6 via the hose when the hose is drawn through the hole towards the location Sl. In this arrangement it is only possible to provide the injection pattern shown in FIG. 3. Continuous injection is possible since injection takes place through a flexible hose.

According to a further arrangement, the drill head 4 and the injection head 6 may be combined into one head, which is provided with nozzles oriented essentially axially as well as essentially radially. During making of the hole H, the radially oriented injection nozzles may be blocked when drill fluid is ejected through the axially oriented nozzles. The latter nozzles may be blocked when the radially oriented nozzles eject injection fluid. Said blockage may be carried out manually or by remote control.

The present invention is not limited to the arrangements described above and shown in the drawings but only by what is stated in the claims.

We claim:

1. A method of providing a substantially leakproof shielding layer (8,9) in ground comprising porous rock and soil, the method comprising:

a) making a plurality of holes (H) in a surface of the ground by means of a guided drill head (4) which ejects ground-decomposing liquid mainly in an advancing direction of the head, and b) passing through each hole an injection head (6) which ejects injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, wherein making a hole is initiated at a first location (S1) and completed at a second location (S2) on the ground surface spaced from the first location, wherein the drill head (4) is connected to a drill string (3) and is connected to the injection head (6) when the drill head has made the hole and is located at the ground surface at the second location, and wherein the injection head is retracted by means of the drill string thereby ejecting injection liquid.

2. A method of providing a substantially leakproof shielding layer (8,9) in ground comprising porous rock and soil, the method comprising:

a) making a plurality of holes (H) in a surface of the ground by means of a guided drill head (4) which ejects ground-decomposing liquid mainly in an advancing direction of the head, and b) passing through each hole an injection head (6) which ejects injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, wherein making a hole is initiated at a first location (S1) and completed at a second location (S2) on the ground surface spaced therefrom, wherein, on completion of making a hole and connecting a cable to one of the drill head (4) and a drill string (3) connected thereto, when one of the drill head and the end of the drill string connected to the drill head is accessible at the second location (S2), said end of the drill string is retracted to the first location, whereupon the injection head (6) is connected to said cable at the second location and is drawn through the hole (H) towards the first location (S1) and then back towards the second location, when injection liquid is ejected in at least one of said drawing directions.

3. A method of providing a substantially leakproof shielding layer (8,9) in ground comprising porous rock and soil, the method comprising:

a) making a plurality of holes (H) in a surface of the ground by means of a guided drill head (4) which ejects ground-decomposing liquid mainly in an advancing direction of the head, and b) passing through each hole an injection head (6) which ejects injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, wherein, after the hole is made, the drill head (4) connected to a drill string (3) is retracted through the hole (H) to the ground surface, and the drill head is then exchanged for the injection head (6), which is repassed through the hole and back again by the drill and ejects injection liquid through the drill string when passing through the hole in at least one direction.

4. A method of providing a substantially leakproof shielding layer (8,9) in ground comprising porous rock and soil, the method comprising:

a) making a plurality of holes (H) in a surface of the ground by means of a guided drill head (4) which ejects ground-decomposing liquid mainly in an advancing direction of the head, and b) passing through each hole an injection he ad (6) which ejects injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, wherein the making of the hole is initiated at a first location (S1) and is completed at a second location (S2) spaced from the first location on the ground surface, wherein, on completion of making a hole and connection of a cable to one of the drill head (4) and a drill string (3) connected to the drill head, when the one of the drill head and an end of the drill string connected to the drill head is accessible at the second location (S2), said end of the drill string is retracted to the first location where said drill head and drill string are disconnected from said cable and the injection head is connected to said cable and is drawn thereby through the hole to the second location and then back towards the first location, while ejecting injection liquid.

5. A method of providing a substantially leakproof shielding layer (8,9) in ground comprising porous rock and soil, the method comprising:

a) making a plurality of holes (H) in a surface of the ground by means of a guided drill head (4) which ejects ground-decomposing liquid mainly in an advancing direction of the head, and b) passing through each hole an injection head (6) which ejects injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, the drill head (4) and the injection head (6) being combined into one head including blockable drilling and injection nozzles.

6. A method according to claim 2, 3, 4 comprising a combined drill head (4) and injection head (6) wherein the combined head ejects ground-decomposing liquid when being passed in a first direction to make a hole and injection liquid when being retracted in a second and opposite direction.

7. A method according to claim 1, 2, 3, 4 or 5 wherein the drill head (4) and the injection head (6) are moved through the hole (H) by a machine.

8. A method according to claim 1, 2, 3, 4 or 5 wherein during advancing in the hole (H) the one of the drill head (4) and the injection head (6) is oriented around its longitudinal axis.

9. A method according to claim 1, 2, 3, 4 or 5 wherein the injection head (6) ejects liquid essentially only in two opposite directions perpendicular to the direction of advance of the injection head.

10. A system for providing a substantially leakproof shielding layer (8,9) in ground comprising porous rock and soil, the system comprising:

a) a guided drill head (4) for ejecting ground-decomposing liquid mainly in an advancing direction of the head for making a plurality of holes in a surface of the ground, and b) an injection head (6) for passing through each hole for ejecting injection liquid essentially transversely to the advancing direction thereof, so that the injection liquid will penetrate into the ground material and will mix therewith and after transition to a solid state, together with injection liquid in an adjacent hole, which has also penetrated into and mixed with the ground material and has transformed into a solid state, will form part of the shielding layer, the drill head (4) and the injection head (6) being combined into one head including blockable drilling and injection nozzles.

* * * * *